United States Patent [19]

Beard

[11] 4,077,549

[45] Mar. 7, 1978

[54] TRIGGER ACTUATOR FOR DISPENSING PUMPS

[76] Inventor: Walter C. Beard, South St., Middlebury, Conn. 06762

[21] Appl. No.: 753,995

[22] Filed: Dec. 27, 1976

[51] Int. Cl.[2] ..... B65D 83/00

[52] U.S. Cl. ..... 222/321; 222/385; 222/402.15

[58] Field of Search ..... 222/320, 321, 385, 402.13, 222/402.15; 151/14.5

[56] References Cited

U.S. PATENT DOCUMENTS

| | | | |
|---|---|---|---|
| 2,865,540 | 12/1958 | Gray | 222/385 X |
| 3,451,980 | 6/1969 | Brownstein | 151/14.5 X |
| 3,478,935 | 11/1969 | Brooks | 222/321 |
| 3,987,942 | 10/1976 | Morane et al. | 222/402.15 |

*Primary Examiner*—Allen N. Knowles
*Attorney, Agent, or Firm*—DeLio and Montgomery

[57] ABSTRACT

A trigger-like actuating element for association with a pump having a depressable piston or plunger for dispensing small metered quantities of a liquid from a container such as a jar, bottle or can, the trigger-like element being designed to be manually operated for substantially horizontal movement to thereby depress vertically the pump piston or plunger in order to deliver a quantity of liquid, usually as a spray, in a horizontal direction.

4 Claims, 7 Drawing Figures

TRIGGER ACTUATOR FOR DISPENSING PUMPS

This invention relates to a trigger actuated pump for dispensing small quantities of a liquid from a container such as a jar, bottle or can, and particularly to the trigger and/or trigger assembly elements of such pumps. Other forms of trigger assemblies are disclosed and claimed in applications Ser. No. 753,992 and Ser. No. 753,991, the latter now abandoned, both filed on Dec. 27, 1976.

Efforts are currently under way to minimize the use of aerosol spray dispensing units (in fact, to eliminate the use of such propellants as the fluorocarbons) and such efforts include the development of pump-type dispensers. Typical examples of such dispensers have spray heads which are vertically depressable and which have laterally opening nozzles, as shown in applicant's U.S. Pat. No. 3,940,028, Feb. 24, 1976.

As an alternative to pumps operated by downward pressure on the spray head, several varieties of trigger type sprayers have been developed, many being based on the device shown in Tyler U.S. Pat. No. 3,061,202, Oct. 30, 1962, and having the piston-cylinder axis either horizontal or at an angle of 45° or less from horizontal. An example of a vertically actuated pump is shown in Hellenkamp U.S. Pat. No. 3,840,157, Oct. 8, 1974, wherein a trigger forces a plunger upward into a cylindrical cavity to discharge the spray horizontally. Another trigger for actuating a vertical pump is shown in Brooks U.S. Pat. No. 3,478,935, Nov. 18, 1969.

It is an object of the present invention to provide a trigger assembly adapted to be combined with a vertically operating pump of the type exemplified by applicant's U.S. Pat. No. 3,940,028 with little or no modification of the pump elements.

It is another object of the invention to provide a trigger assembly by which the spray head (modified or not) of a vertically operating pump can be depressed to eject or spray in a manner comparable to the manual depression of a spray head.

It is a further object of the invention to provide such a trigger assembly wherein the components are of simple form and can be made and assembled inexpensively to constitute a very effective operating unit.

It is yet another object of the invention to provide certain improvements in the form, construction and arrangement of the several parts whereby the above-named and other objects may effectively be attained.

The invention accordingly comprises an article of manufacture possessing the features, properties, and the relation of elements which will be exemplified in the article hereinafter described, and the scope of the invention will be indicated in the claims.

Practical embodiments of the invention are shown in the accompanying drawings, wherein.

Figure 1:
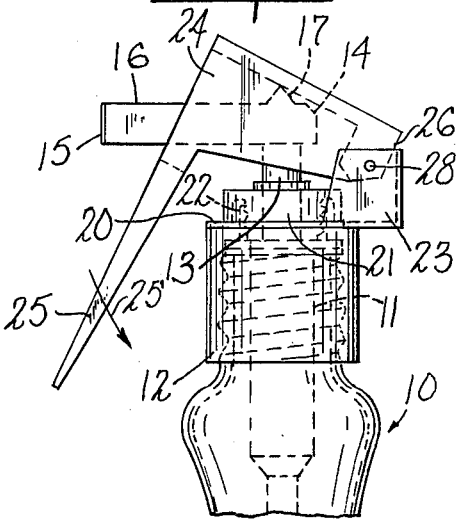
FIG. 1 represents an elevation of one form of trigger in combination with a pump and container, the trigger being in released position.
Figure 2:
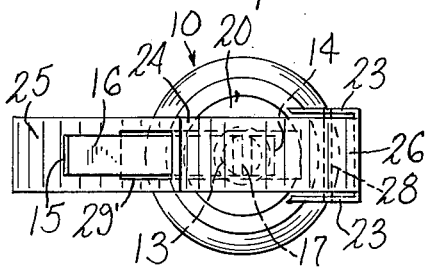
FIG. 2 represents a top plan view of the assembly shown in FIG. 1.
Figure 3:
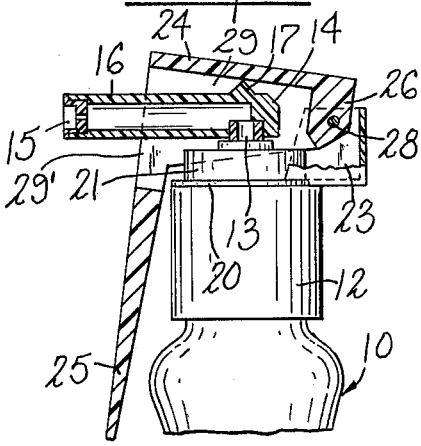
FIG. 3 represents an elevation, as in FIG. 1, with the trigger in depressed position, parts being broken away.

Referring to the drawings, and particularly to FIGS. 1 to 3, a container 10 such as a bottle or can is shown as being equipped with a pump mechanism 11 fixed in the top of a screw cap 12 on the neck of the container, the pump having an upwardly projecting tubular plunger 13 on which is mounted the push button 14 containing a spray nozzle 15. The push button 14 is functionally comparable to the push button 41 in applicant's U.S. Pat. No. 3,940,028, but is modifed to include a horizontally extending tubular portion 16 having the spray nozzle 15 at its distal end. The push button is provided also with an upwardly projecting peak or ridge 17, located approximately on the axis of the plunger 13.

The trigger assembly for operating the pump just described includes a flat annular base 20 engaged tightly between the pump collar 21 and the top of the cap, the collar having an inner portion which engages a ring 22 on the pump with a snap or friction fit. The base supports a pair of parallel guide walls 33 extending upwardly therefrom and spaced to accommodate a trigger. The trigger includes a hollow upper body portion 24 and the depending finger piece 25, the body portion being closed at its rear end 26 and pivotally mounted between the walls 23 by means of a pin 28. The side walls of the cavity 29 in the body portion may suitably be parallel and spaced to clear freely the sides of the push button 14 and its extension 16, as shown in FIG. 2. The extension projects to and through an opening 29' in the trigger so that spray exiting the nozzle 15 is clear of all mechanical parts as well as the finger or fingers on the finger piece 25. The top wall of the cavity is shown as being straight and flat, at least in the area where it rests against the peak or ridge 17 (FIGS. 1 and 3); smoothness is essential, since the peak or ridge 17 slides along the surface of the wall 29, when the trigger is actuated.

The finger piece 25, at rest, is spaced from the container neck and below the nozzle 15 (FIG. 1); upon actuation in the direction of the arrow 25' the finger piece moves toward the position shown in FIG. 3 and the push button, nozzle and plunger are depressed, with expulsion of the container contents through the nozzle.

The distance between the pivot pin 28 and the peak or ridge 17 is substantially less than the distance between the pin and the area of the finger piece 25 which would normally be engaged by the user's finger so that the lever arm, in use, results in multiplication of the force, the push button thus being depressed effectively by the exertion of relatively little finger power. Throughout the operating stroke, the force exerted by the wall 29 on the peak or ridge 17 has only a small lateral component in comparison to the vertical component and hence depresses the plunger with minimal tendency toward binding.

Figure 4:
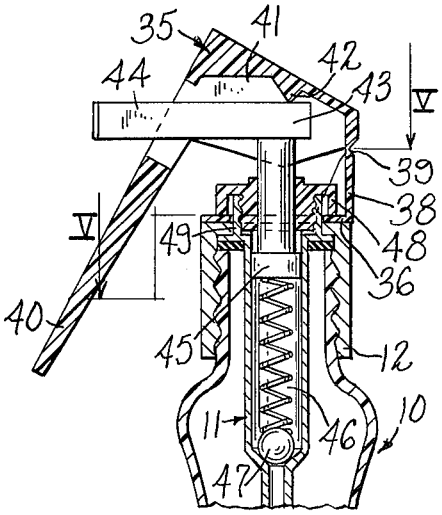
FIG. 4 represents a vertical section of a first modified form of trigger assembly, in released position.

In the first modified form of trigger, shown in FIG. 4, the trigger 35 is integral with the base 36, being connected at one end to the post 38 by a hinge 39, of the same plastic material forming the other trigger assembly parts. The trigger is similar to that shown in FIGS. 1 to 3, having a depending finger piece 40 and a hollow upper body portion 41, but the top wall of the cavity is provided with a peak or ridge 42 so located as to bear on the upper surface of tubular extension 44 of the push button 43, in the vicinity of the axis of the push button.

Downward and inward pressure on the finger piece 40 will cause the trigger to rotate around the hinge 39 so that the peak or ridge 42 will depress the push button as it slides along the top of the extension 44. The parts should be so proportioned that the sliding stroke extends about equally each direction from the axis of the push button, in order to minimize the lateral moment of the applied force.

FIG. 4 also shows such basic components of a typical pump as the piston 45, cylindrical chamber 46 and one-way valve 47 on the dip-tube end of the chamber. Another one-way valve, in the piston, is not shown. The collar 48, corresponding to collar 21 in FIG. 1, is snap fitted on an upward extension 49 of the chamber wall.

Figure 5:
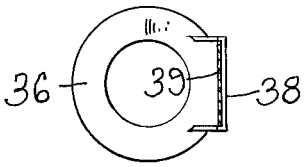
FIG. 5 represents a horizontal section of the trigger assembly on the line V—V of FIG. 4.
Figure 6:
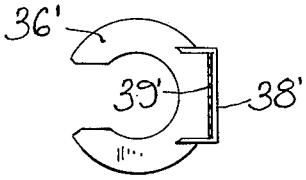
FIG. 6 represents a section, as in FIG. 5, showing a modified form of mounting ring.

Referring to FIGS. 5 and 6, the annular base 36 is designed for use when the trigger assembly is to be mounted on the pump as "original equipment", being placed on the pump beneath the collar 48 as a step in the manufacture of the whole unit. FIG. 6 shows an annular base 36', with post 38' and trigger hinge 39', the base having one side cut away so that it can be mounted on an otherwise complete pump. In this case it is necessary merely to pry up the collar and snap the base 31' into the space thus provided, as will readily be understood.

Figure 7:
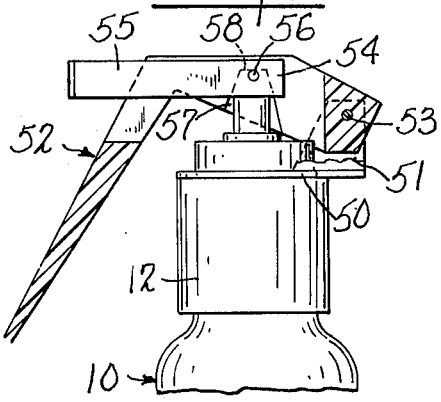
FIG. 7 represents an elevation of a second modified form of trigger assembly, in released position.

In the second modified form shown in FIG. 7 the base 50 is provided with walls 51, similar to the walls 23 in FIG. 1 and the trigger 52 is pivotally connected thereto by a pin 53, like pin 28. The push button 54 has an extension 55, as described above, and is provided with laterally projecting lugs 56 on opposite sides of the push button and in the plane of the push button axis. The trigger is bifurcated with parallel inwardly facing walls, each recessed as shown at 57 to provide downwardly facing bearing surfaces 58 in position to engage the lugs 56. The surfaces 58 are long enough to permit relative sliding movement of the lugs on the surfaces as the trigger is pulled, the push button being thus depressed to actuate the pump. The angle of the surface 58 may be designed to minimize lateral force on the push button during the operating stroke.

Most currently used dispensing pumps are constructed with elements corresponding to the collars 21 and 48 adapted to be snapped or otherwise fitted onto or into a complementary pump element in a manner permitting the addition of an annular or open sided trigger base (such as 20, 36, 36' or 50), so that trigger and base assemblies of the types shown and described above require only adaptation to the pertinent diameter and heights of particular pumps in order to be added thereto. In each of the forms shown the actuation of the pump is effected through a sliding engagement of a trigger part with a push button part, communicating predominantly axial force to the push button as the trigger is pulled.

In order to equip a pump as shown in applicant's U.S. Pat. No. 3,940,028 with a trigger mechanism according to any of the forms shown and described herein, it is necessary to replace the cylindrical push button 41 of the patent with a laterally extended push button of the selected type, and to affix the annular base of the trigger assembly to the cover portion 19 of the cap, as by means of a suitable adhesive. Such attachment can be resorted to in most situations where an element such as the collar 21 or 48 is not available.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

What I claim is:

1. In combination with a pump for dispensing liquid from a container, the pump being adapted for actuation by vertical depression of a push button on the plunger, and having a nozzle spaced from the axis of the plunger at the end of an elongated lateral extension of the push button for directing laterally the dispensed liquid, the pump further being provided with a collar element adapted to bear against the top surface of a container cap, pump actuating means comprising an annular base adapted to be held in place between said collar element and said top surface for securement of said means on the top of the container closure member, trigger support means projecting upward from the base and a trigger pivotally connected to the support means, the trigger having a body portion provided with a chamber adapted to contain a portion of the push button extension, said chamber having a lateral opening through which the nozzle end of the extension can project, and a finger piece projecting downwardly below the nozzle, the trigger body portion and push button extension being provided with cooperating parts adapted for sliding engagement to depress the plunger when the finger piece is pulled to rotate the trigger about its pivotal connection.

2. Pump actuating means according to claim 1 wherein the chamber in the body portion has an upper wall and the cooperating parts are constituted by the surface of said wall and an upwardly projecting element on the push button.

3. Pump actuating means according to claim 1 wherein the chamber in the body portion has an upper wall and the cooperating parts are constituted by the upper surface of the push button and a downwardly projecting element on the upper wall.

4. Pump actuating means according to claim 1 wherein the chamber in the body portion has lateral walls each recessed to provide a downwardly facing surface and the cooperating parts are constituted by said surfaces and lugs projecting laterally from opposite sides of the push button.

* * * * *